United States Patent [19]

Roy

[11] Patent Number: 4,486,997

[45] Date of Patent: Dec. 11, 1984

[54] INSULATING STRUCTURE

[76] Inventor: Donald H. Roy, 544 Fern Park Dr., Glendora, Calif. 91740

[21] Appl. No.: 546,638

[22] Filed: Oct. 28, 1983

Related U.S. Application Data

[63] Continuation of Ser. No. 264,227, May 18, 1981, abandoned, which is a continuation-in-part of Ser. No. 93,391, Nov. 13, 1979, abandoned.

[51] Int. Cl.[3] ..... E04B 1/74

[52] U.S. Cl. ..... 52/404; 52/407

[58] Field of Search ..... 52/404, 406, 407, 743, 52/800, 801

[56] References Cited

U.S. PATENT DOCUMENTS

| | | | |
|---|---|---|---|
| 1,913,312 | 6/1933 | Lines | 52/406 |
| 2,251,585 | 8/1941 | Finck | 52/406 |
| 2,264,976 | 12/1941 | Heritage | 52/406 |
| 2,569,234 | 9/1951 | Fink | 52/406 |
| 2,750,313 | 6/1956 | Schwartz et al. | 52/406 |
| 2,777,786 | 1/1957 | Schwartz et al. | 52/406 |
| 2,906,655 | 9/1959 | Blumenstein | 52/406 |
| 3,229,441 | 1/1966 | Heffner | 52/743 |
| 4,045,931 | 9/1977 | Becker | 52/406 |
| 4,172,345 | 10/1979 | Alderman | 52/406 |
| 4,318,260 | 3/1982 | Siegel et al. | 52/407 |

*Primary Examiner*—John E. Murtagh
*Assistant Examiner*—Andrew Joseph Rudy
*Attorney, Agent, or Firm*—Boniard I. Brown

[57] ABSTRACT

An elongated insulating structure, for installation adjacent a structural surface having supporting structures extending at right angles therefrom, including first and second sidewalls orientated in spaced mutually parallel relationship. Each of the sidewalls has an inner edge and an outer edge and first and second oppositely disposed ends. The first side wall includes a tab strip along the inner edge thereof which is foldable outwardly upon itself to enable connection of the inner edge of the first supporting structure to the associated first supporting structure adjacent the structural surface after connection of the inner edge of the second associated supporting structure adjacent the structural surface. A plurality of reflective foil sheets extend intermediate the first and second sidewalls. In another form of the invention which is particularly suitable for use in insulating roofs, the sidewalls of the insulating structure depend from the structural members, such as the rafters.

8 Claims, 13 Drawing Figures

INSULATING STRUCTURE

This is a continuation of co-pending application Ser. No. 264,227 filed May 18, 1981, which is a continuation-in-part of application Ser. No. 093,391, filed Nov. 13, 1979 both abandoned.

BACKGROUND OF THE INVENTION

This invention relates to thermal insulation and particularly to thermal insulation for buildings. Many types of insulation adapted to be placed between a source of heat and a sink for the same are known in the art. Such insulation is useful in keeping the internal volume of a structure warmer or colder than the surrounding atmosphere. When such is to be accomplished, insulation is included in the walls, the ceiling and sometimes the floor surrounding such structures so that they exhibit as low a thermal transmission coefficient as possible consistent with the economics produced.

In particular, it is known to utilize materials provided with internal subdivisions so as to reduce direct heat conductivity paths and to suppress the tendency of gases trapped in the internal subdivisions to transfer heat through natural convection. Commonly employed insulating materials include mineral wool, glass fiber batts, plastic and elastomeric foams, low-density ceramics and others. They operate on the principle of defining a volume with the least possible solid mass while separating air entrapped in the matrix into small independent cells in which convection is greatly diminished.

It is also well known that reflective surfaces, such as bright metal foils have a tendency to reflect incident radiant heat, a form of electomagnetic radiation, toward the source. The combination of the aforementioned insulating techniques is also known, for example, in commercial glass fiber insulation disposed in paper enclosed batts having one or more surfaces thereof composed of, or laminated with, an aluminum foil surface. Such materials are commonly installed between the studs in stud wall structures and provide a barrier to heat transfer by conduction, convection, and radiation. In some applications, economically effective insulation can be provided by merely placing spaced layers of reflective foil parallel to the surface to be insulated, and mounting and orienting the foil layers so convection and conduction are reduced. Typical structures of this type are manufactured by Louis Hafers Co., 1514 Chestnut Street, Alhambra, Calif. and are described in Schwartz, U.S. Pat. No. 2,750,313. To be efficient, the reflective layers must be spaced from each other and tightly held laterally against adjacent structure such as the supporting studs thereof. Unfortunately, such constuctions with multiple layers of spaced foil extending between side supports have rectangular cross-sections which can be attached to the structure only at three corners thereof, as the fourth corner becomes inaccessible during installation. Therefore, although such structures are lightweight, relatively inexpensive and theoretically have good insulating characteristics, the difficulty of their complete installation without insulation faults reduces their effectiveness considerably or makes their installation extremely complex.

SUMMARY OF THE INVENTION

An elongated insulating structure for installation adjacent a structural surface has first and second supporting structures extending at right angles therefrom including first and second sidewalls orientated in spaced mutually parallel relationship. Each of the sidewalls has an inner edge and an outer edge and first and second oppositely disposed ends. The first side wall includes a tab strip along the inner edge thereof which is foldable 180 degrees outwardly upon itself to enable connection of the inner edge of the first supporting structure to the associated first supporting structure adjacent the structural surface after the inner edge of the second sidewall is secured to the second associated supporting structure adjacent the structural surface. A plurality of reflective foil sheets extend intermediate the first and second sidewalls.

In another form of the invention which is particularly suitable for use in insulating roofs, the sidewalls of the insulating structure depend from the structural members, such as the rafters, and a plurality of reflecting foil sheets, which extend intermediate the first and second sidewalls, are disposed at a lower elevation than the rafters on which the insulating structure is mounted. Insulating structures disposed between adjacent pairs of rafters are ordinarily joined together to improve the insulating characteristics of the entire installation.

The first sidewall and the included tab strip may be constructed from relatively stiff material. The tab strip is, in some embodiments, formed from a portion of the first sidewall. The tab strip is defined by fold enabling means along the inner edge of the first sidewall. A plurality of reflective foil sheets are connected to the first and second sidewalls. The foil sheets are ordinarily oriented in spaced parallel relationship to each other and extend generally at right angles between the first and second sidewalls and from the first ends to the second ends of the first and second sidewalls.

BRIEF DESCRIPTION OF THE ACCOMPANYING DRAWING

DESCRIPTION OF THE PREFERRED EMBODIMENTS

Figure 1:
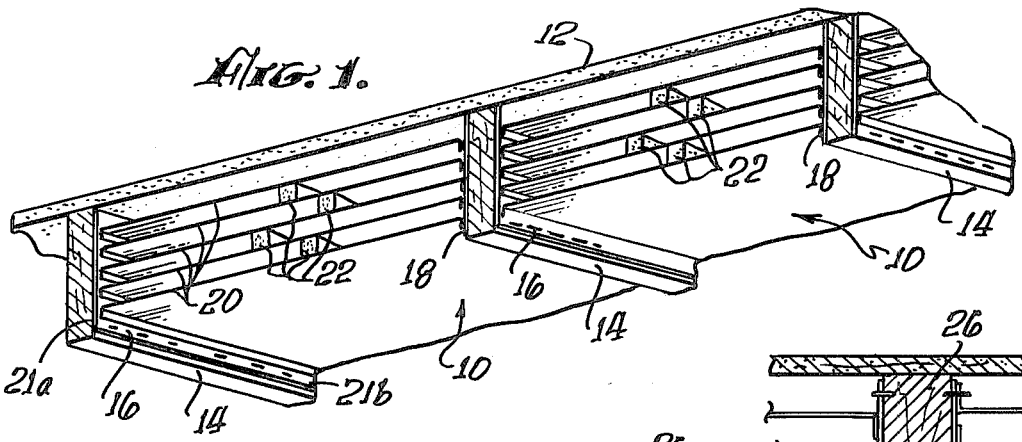
FIG. 1 is a perspective view of insulating structure constructed according to the present invention installed between studs in a ceiling.

Referring to the drawings more particularly by reference numbers, numeral 10 in FIG. 1 refers to an insulating structure constructed according to one form of the present invention. The structure 10 is shown installed adjacent a ceiling 12 between ceiling supporting joists 14. The insulative structure 10 includes opposite side members 16 and 18 between which are extended a plurality of parallel, spaced, reflective foil sheets 20 from end 21*a* to end 21*b* thereof. The sheets 20 may have low heat conduction, and have resilient spacers 22 positioned therebetween. Flexible foam material is suitable for such spacers 22.

Figure 3:
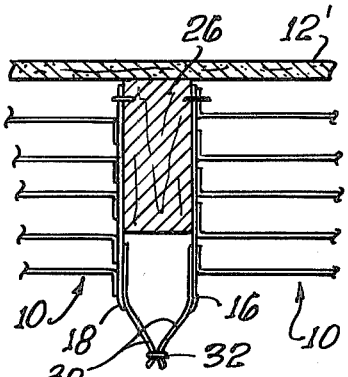
FIG. 3 is a cross sectional view of the insulating structure of FIG. 1 installed on a stud which is narrower than the width of the insulating structure.
Figure 2:
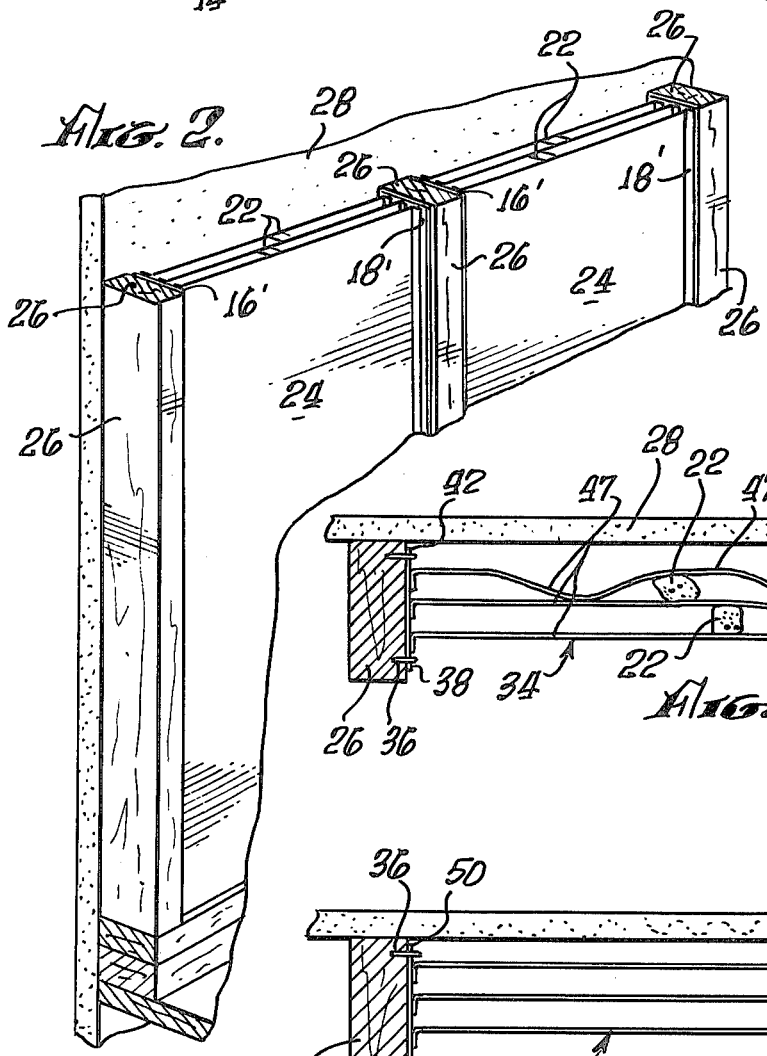
FIG. 2 is a perspective view of insulating structure constructed according to the present invention installed between side members of a wall.

FIG. 2 shows a similar insulating structure 24 having fewer sheets 20 extending between side members 16 and 18. The insulating structure 24 is adapted to be placed between the normal 2×4 studs 26 of a wall 28. When it is desired to install the structure 10 between 2×4 studs 26 or joists for a ceiling 12, the side members 16 and 18 may be provided with flexible extension tabs 30 as shown in FIG. 3. The tabs 30 can be tied together by suitable means such as staples 32 so that the benefits of the thicker insulating structure 10 can be achieved.

Figure 4:
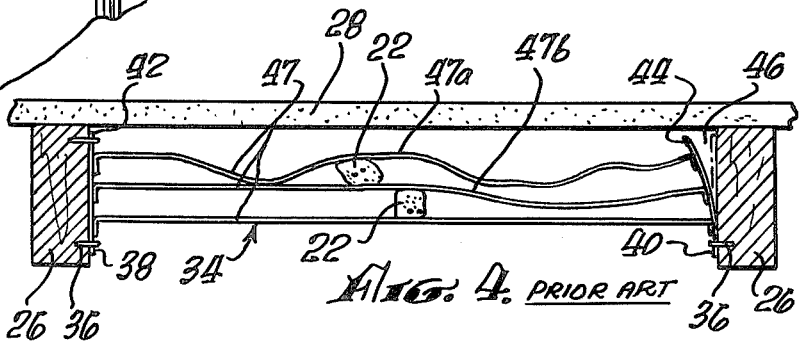
FIG. 4. PRIOR ART
FIG. 4 is a side view of insulation constructed according to the prior art which is installed with an insulating fault which occurs because of the difficulty of installation.

A prior art structure 34 similar to the structure 24 is shown installed between studs 26 adjacent a wall 28 in FIG. 4. When the structure 34 is installed, staples 36 are driven through the side members 38 and 40 thereof into the adjacent stud 26. Unfortunately, when the inward portion 42 of one of the side members 38 is stapled it eliminates access to the similar inward corner portion 44 of the opposite side member 40. Therefore, the structure 34 can be tied down only at three of its four corners resulting in an insulative fault 46, which in addition to providing an uninsulated path, also allows the reflective sheets 47*a* and 47*b* to collapse against each other to cause a conductive heat path.

Figure 5:
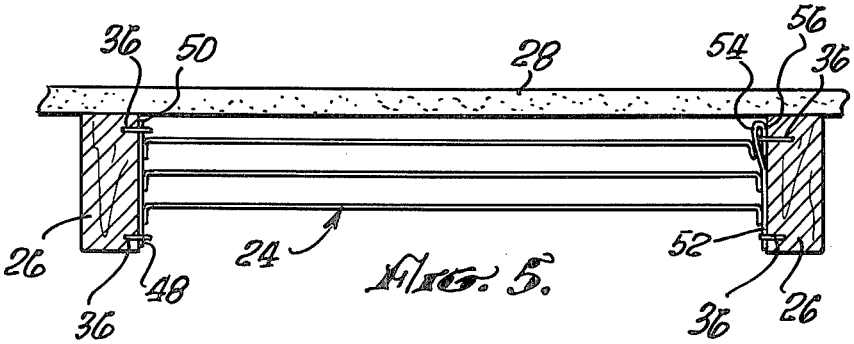
FIG. 5 is a view similar to FIG. 4 illustrating the installation characteristics of the present invention to overcome the fault of FIG. 4.

The problem is solved in the present invention, as shown in FIG. 5, wherein the structure 24 is fastened to studs 26 adjacent the wall 28 by staples 36 at all four corners 48, 50, 52, and 54 thereof. The corner 54 can be connected to the adjacent stud 26 because the side member 18 includes a foldover tab strip 56 through which the staples 36 can be driven into the stud 26, thus securing the fourth and previously nonfastened corner 54 to assure that no insulation fault is present.

Figure 6:
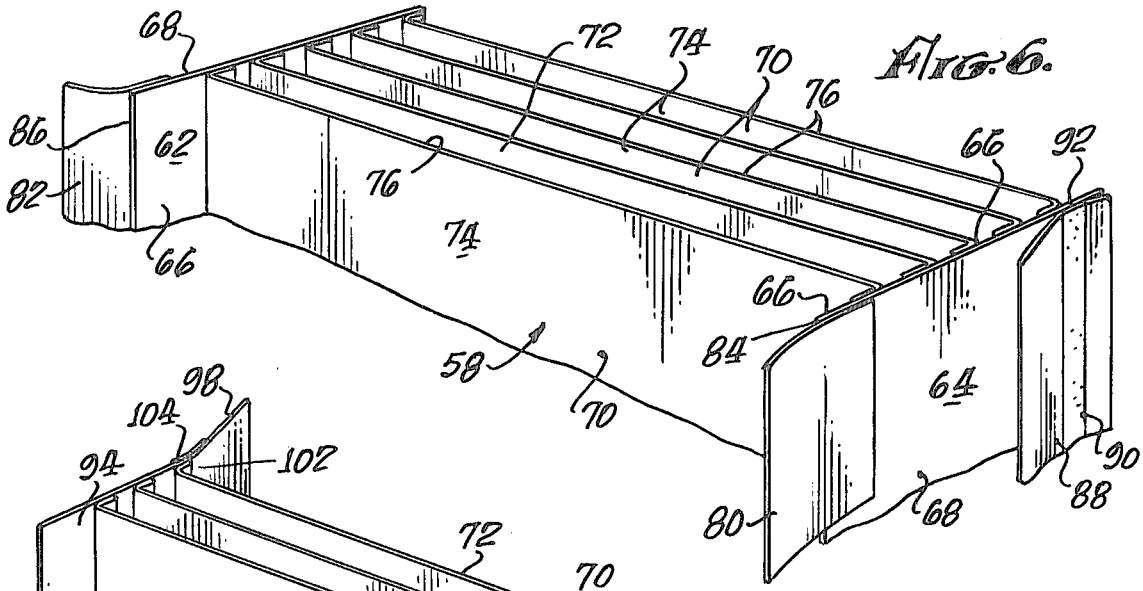
FIG. 6 is a detailed perspective view of a modified embodiment of the insulating structure shown in FIGS. 1 through 3 and 5.
Figure 7:
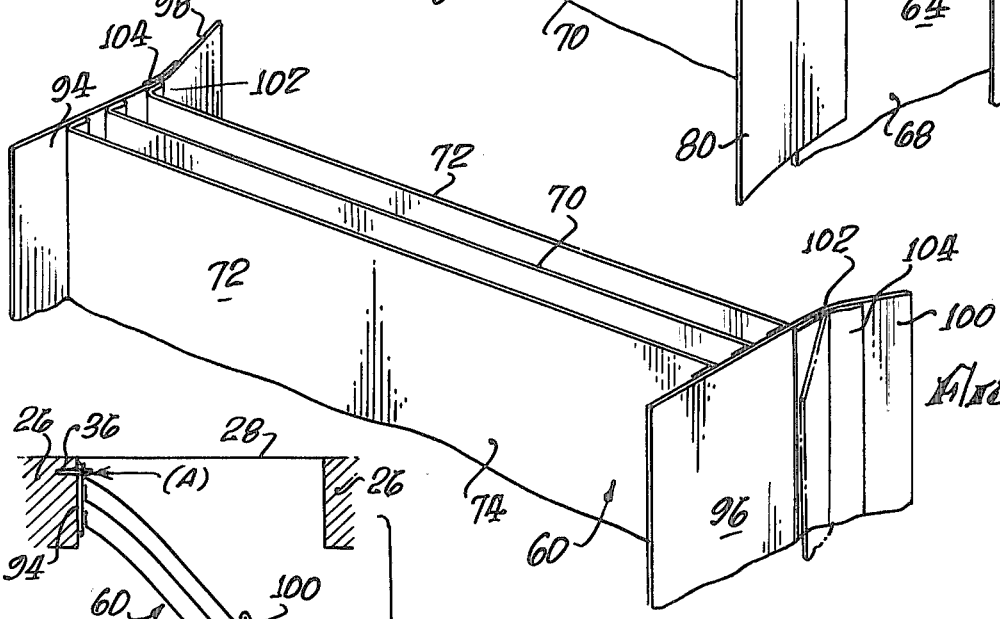
FIG. 7 is a perspective view of another form of the present insulating structure primarily constucted for use on walls constructed with 2×4 studs.

Two typical insulative structures 58 and 60 are shown respectively in FIGS. 6 and 7 with structure 58 being similar to structure 10 and structure 60 being similar to structure 24. In the structure 58, the side members 62 and 64 thereof are constructed from a relatively stiff cardboard or paper layer 66 which may have reflective foil 68 applied to one or both sides thereof. Insulative foil sheets 70 and 72 extend between the side members 62 and 64. As shown, alternate sheets 70 include a reflective foil layer 74 and a kraft paper layer 76 whereas sheets 72 are constructed from foil alone. The paper strengthens the sheets 70, improves their insulating characteristics and by facing the reflective layers toward the outside, as shown, provides an attractive appearance for the structure 58 no matter which sheet 70 thereof faces outwardly. Paper tab strips 80 and 82 may be provided adjacent the outer edges 84 and 86 of the structure 58 to provide means similar to the tab strips 30 in FIG. 3 to attach adjacent structures 58 together when the attachment joist or stud is not as wide as are the side members 62 and 64. When the tab strips 80 and 82 are not required, they can be folded back on themselves and stapled in that location when the outer edges 84 and 86 are stapled to the studs or joists. Another tab strip 88 is adhesively bonded at an intermediate location 90 thereof adjacent the inner edge 92 of at least one of the side members 60 or 62.

Figure 8:
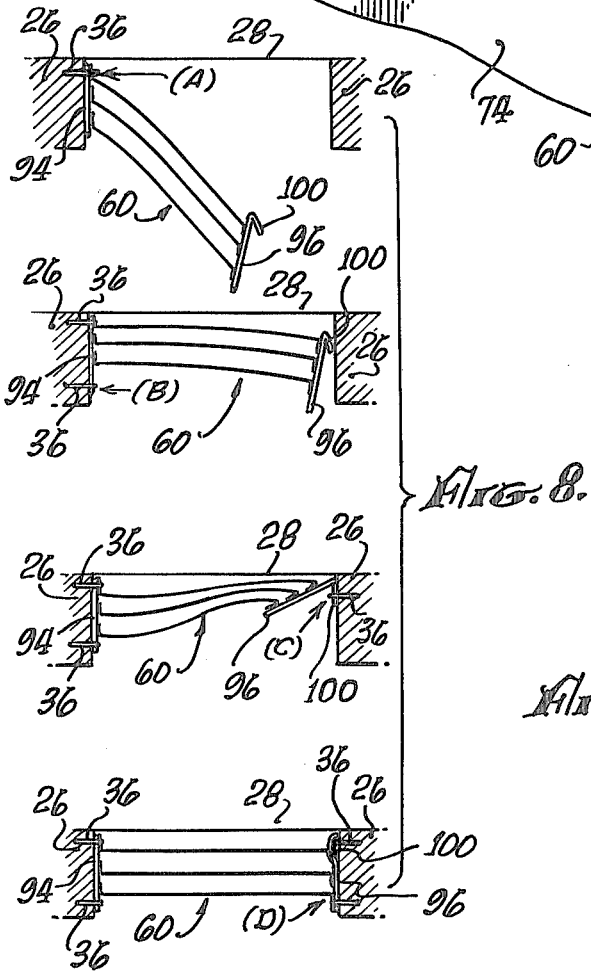
FIG. 8 is a diagrammatic view of the installation of the present insulating structure.

A similar structure 60, not having the front tab strips 80 and 82, is shown in FIG. 8. The structure 60 is constructed having only two sheets 72 and one sheet 70. In the structure 60, one or both side members 94 and 96, constructed in a manner similar to side members 62 and 64, include inward tabs 98 and 100 to fold outwardly 180 degrees. The score 102 may be reinforced by a paper strip 104.

As shown in FIG. 8, the structure 60 is installed by first driving staples 36 into the stud 26 at (A) and (B) through the side member 94. Thereafter, the tab strip 100 is partially folded over and held against the opposite stud 26 by staples 36, which are driven at (C) through what was originally a portion of the outside of the member 96, to fasten the inside of the side wall member 96 in contact with stud 26. Thereafter the member 96 is folded 180 degrees from the tab 100 and stapled at (D).

Figure 9:
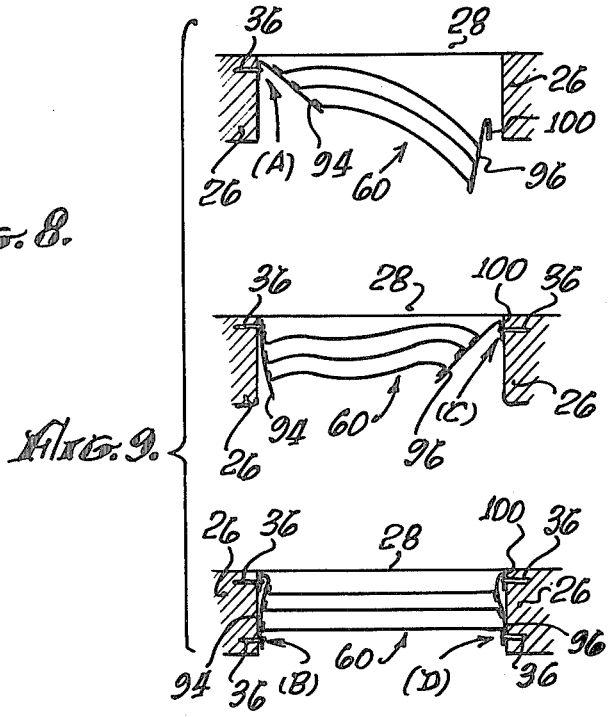
FIG. 9 is a diagrammatic view similar to FIG. 8 of a modified method for installing the present insulating structure.

As an alternate method, as shown in FIG. 9, the tabs 98 and 100 can be utilized on both sidewall members 94 and 96. They are connected to the studs 26 at (A) and (C) in a manner similar to that shown in FIG. 8 and the installation is completed by stapling the sidewall members 94 and 96 at (B) and (D). It is particularly advantageous that the structure 60 be laterally symmetric since it is intended to be rolled for storage or delivery. An asymmetric structure is difficult to roll because it tends to form rolls having a generally conical form at best.

The insulation installation methods shown in FIGS. 8 and 9 are adaptable to the insulating structures 10, 24, and 58, with the installation of structure 60 only being shown as an example.

Figure 10:
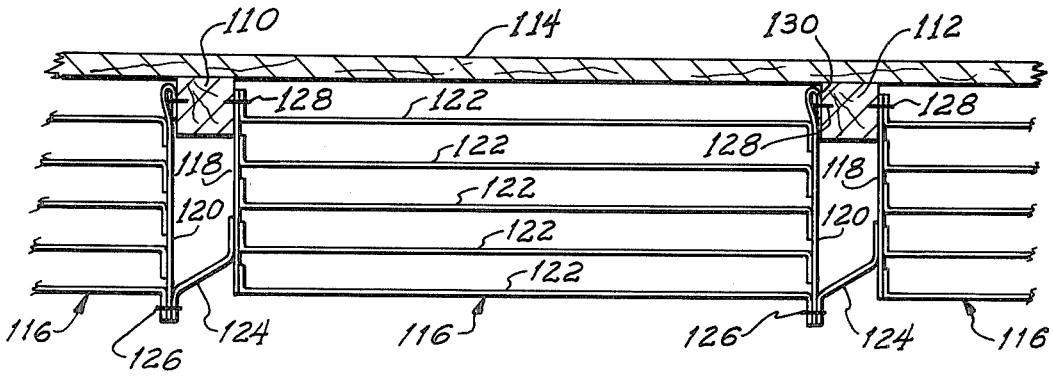
FIG. 10 is a side view of insulation constructed according to another form of the invention.
Figure 11:
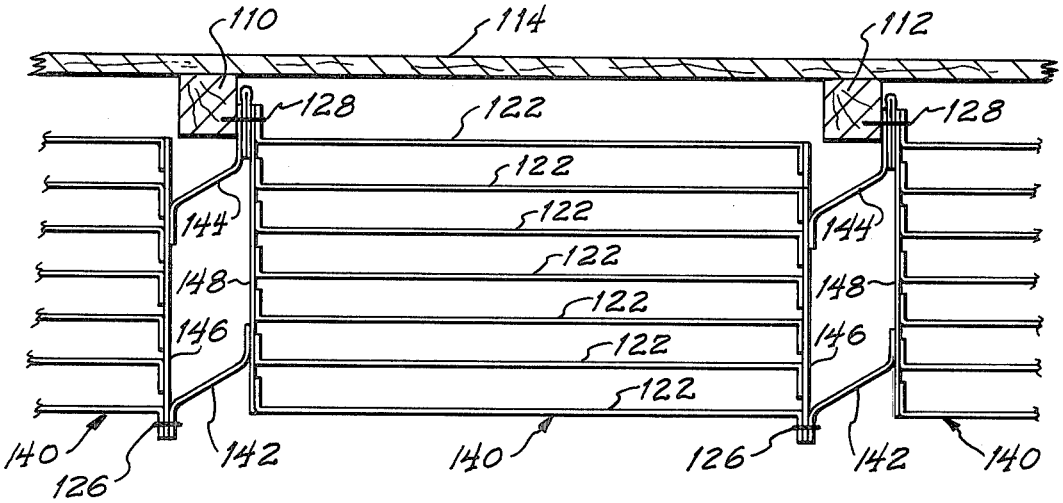
FIG. 11 is a side view of insulation constructed according with still another form of the invention.
Figure 12:
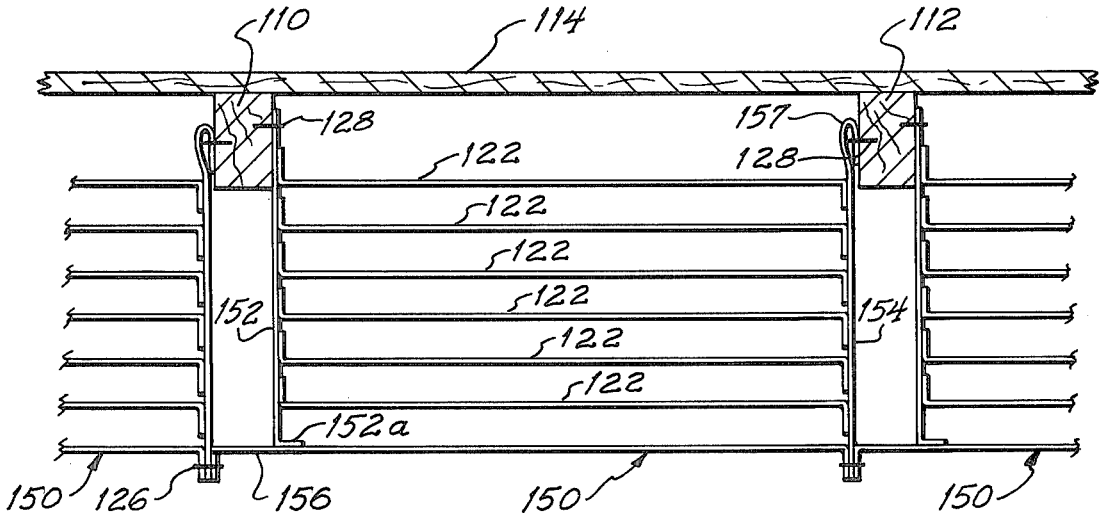
FIG. 12 is a side view of insulation constructed according to still another form of the invention.

Referring now to FIGS. 10–13, there are shown four additional embodiments of the apparatus in accordance with the invention, which are particularly adapted for use with the rafters of a roof. It will be understood, of course, that those embodiments may be used on oblique as well as flat roofs, where the "ceiling" may be merely the underside of the roof. These structures are also installed in the manner illustrated in FIGS. 8 and 9. It will be understood that the entire insulating structure is composed of discrete sections which for convenience may be referred to as modules. Referring particularly now to the embodiment of FIG. 10, there is shown a portion of a building having spaced generally parallel rafters 110, 112. Sheathing 114 is carried on the rafters 110, 112. The insulating structure 116 is provided with side or end members 118, 120. Extending intermediate the side or end members 118, 120 are a plurality of parallel, spaced, reflective foil sheets 122. As do the sheets 20, the sheets 122 also have a low heat conduction. The structures illustrated in FIGS. 10–12 are particularly advantageous in that additional insulation may be achieved merely by providing additional reflective sheets 122. In other words, the side or end members 118, 120 are merely lengthened and additional reflective foil sheets 122 are positioned therebetween. A flexible tensioning member 124 is fixed to the side or end member 118 of the insulating structure 116. The opposite extremity thereof is fixed to the adjacent side wall 120 by means of a staple 126 or other similar fastening device. The tensioning member 124 is typically fabricated of a paper of aluminum foil secured during manufacture to the side or end member 118. During installation of the insulating structure 116, the tensioning member 124 is drawn or pulled across or down and under the stud or beam 110.

Advantageously, the drawing over and stapling of the tensioning member 124 draws the parallel reflective foil sheets 122 into their correct generally parallel configuration by applying tension to them to place them in proper configuration for use. The embodiment of FIG. 10 is particularly advantageous because of the ease with which additional insulation can be achieved by merely adding extensions to the side or end members 118, 120. It will be understood that the upper end (as viewed) of the side or end members 118, 120 may be referred to as the inner end and the bottom end thereof may be referred to as the outer end. The vertical dimension of the rafters 110, 112 may be relatively small. For example, it may be only approximately 2 inches in some applications. The use of the insulating structure 116 is particularly advantageous when such relatively small rafters are utilized, since the insulating structure 116 does not rely on the presence of a space merely in between the rafters. The rafters 110, 112 need not be manufactured of wood, although this will be the most common material. Ordinarily, the side or end member 118 will be secured to the rafter 110 by means of a nail 128. After such nailing has been accomplished, the tab 130 of the end member 120 is secured by means of a nail 128 to the rafter 112. As shown in the drawing, the respective attachments are to the facing sides of the rafters 110, 112. Then the tensioning member 124, which is ordinarily glued to the side or end member 118, is fastened to the side or end member 120 by any of various well known fastening techniques. The illustrated embodiment utilizes a staple 126 to provide the necessary positive joining between depending flanges of end member 120 and tensioning member 124. It will be understood that the manner of use of the tab 130 is substantially the same as the tab 100 illustrated in FIG. 8.

Referring particularly now to FIG. 11, there is shown another embodiment of the invention which is somewhat similar to the embodiment illustrated in FIG. 10. In this embodiment all of the sheets 122 are essentially below the lowest extremity of the rafters 110, 112. In other embodiments only the majority of the sheets 122 are disposed below the lowermost extremity of the rafters 110, 112. The insulating structure 140 is generally similar to the insulating structure 116 except that tensioning members 142, 144 are provided to join adjacent insulating structures 140. The tensioning member 144 is ordinarily secured to the end member 146 by glueing or other means. Similarly, the tensioning member 142 is fastened by glueing or other similar means to the end member 148. During installation the tensioning member 144 is doubled over to a generally U-shaped section and fastened together with the end member 148 by a nail or tack 128. The tensioning member 142 and the end member 146 are ordinarily joined by means of a staple 126. Other well known fastening means may be used. This embodiment of the invention has the particular advantage that a minimum of nails or staples 128 are necessary in order to install the insulating structure 140. The installation sequence ordinarily involves the installation of the successive insulating structures or members 140, starting from the left, as viewed in FIG. 11. Additionally, the left most insulating structure 140 is secured by its tensioning member 144 to the rafter 110. Simultaneously, the end member 148 is also joined to the rafter 110. Thereafter the end member 146 is joined to the rafter 112 simultaneously with the end member 128 of the next insulating structure 140. In the embodiments of FIGS. 10 and 11, the tensioning members 124, 144, 142 extend generally obliquely with respect to the end members with which they cooperate.

Figure 13:
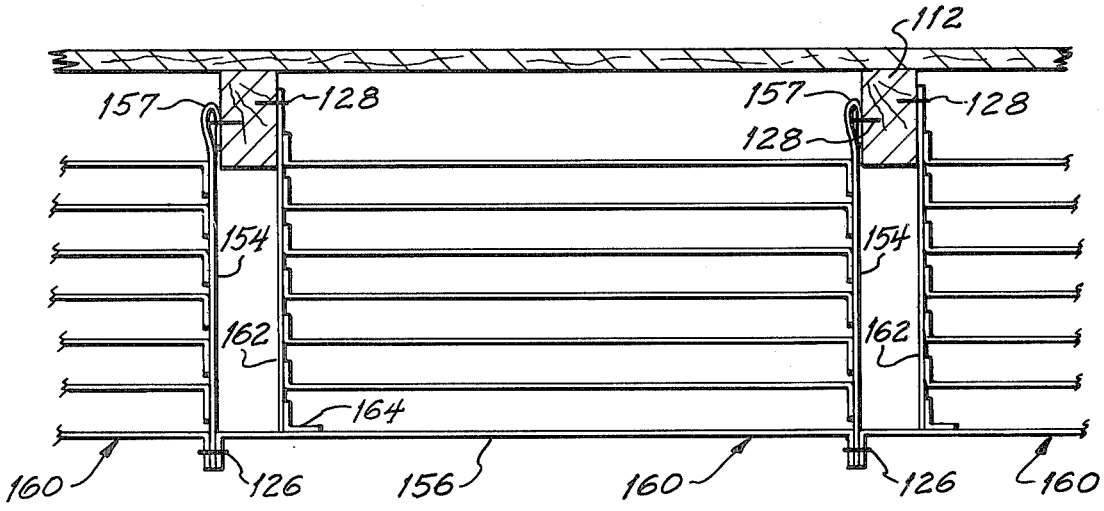
FIG. 13 is a side view of insulation constructed according to still another form of the invention.

Referring now to FIGS. 12 and 13, there are shown two additional embodiments of the invention which utilize tensioning members which extend generally horizontally and are integral with the lowest sheet of the structure. Referring particularly to FIG. 12, there is shown an insulating structure 150 which has (as viewed) left and right side members identified by the numerals 152, 154. The end member 152 is joined to the rafter 110 by means of a tack, nail or staple 128. The end member 154 is then fastened by means of the generally U-shaped tab 157 by a tack or nail 128 to the rafter 112. This procedure is continued so that adjacent insulating structures 150 are mounted between pairs of rafters 110, 112. Thereafter, the tensioning member 156 is joined to the adjacent insulating structure 150. More specifically, the tensioning member 156 is merely part of the lower most sheet of the insulating structure 150. In other respects, the insulating structure is generally similar to that illustrated in FIGS. 10 and 11. More specifically, the insulating structure 150 includes a plurality of insulating sheets 122 which are generally similar to those utilized in the embodiments of FIGS. 10 and 11. The tensioning member 156 is joined to the adjacent tensioning member 156 by means of a staple 126. The tensioning member 156 is in other words a single sheet extending across the entire lower extremity of the insulating structure 150. The reflective foil sheet 122 ordinarily will have one side (as viewed) folded at a ninety degree angle to interface with the side member 152. Similarly, the other side (as viewed) will be folded at a ninety degree angle to interface with the side member 154. The side member 152 similarly will have the lower extremity thereof folded at a ninety degree angle to interface with the tensioning member 156. As in each of the embodiments in FIGS. 10–13, the tensioning member 156 (or equivalent structure) is positioned to maximize the precise position of the insulating structure, such as 150, to insure that the reflective foil sheets 122 are generally parallel. The embodiment of FIG. 12 is advantageous in that the general appearance of the insulating structure, as viewed from below, is substantially uniform and without any gaps. Only the juncture at the staple 126 breaks up an expanse of aluminized sheets 156.

Referring now to FIG. 13, there is shown an embodiment of the apparatus in accordance with the invention which is generally similar to the embodiment of FIG. 12. The primary difference is in the construction of the left side member which is identified by the numeral 162. The side member 162 is generally planar and is not provided with a fold, such as that identified by the numeral **152*a* in FIG. 12. Instead, the lower extremity of the side member 162 butts into the lower planar member or tensioning member 156, and a discrete generally L-shaped cross-section member 164 is provided to join side member 162 and the tensioning member 156. The L-shaped cross-section member 164 is additionally reinforced to insure structural rigidity and to minimize any tendency for the insulating structure 162 to move from the geometric relationship illustrated in FIG. 13**.

It will be understood that the embodiments of FIGS. 10–13 may incorporate the various features described with respect to the other embodiments, such as paper backing.

Thus, there has been shown and described novel insulating structures which fulfill all the objects and advantages sought therefor. Many changes, modifications, variations and other uses and applications of the subject invention will, however, become apparent to those skilled in the art after considering the foregoing specification together with the accompanying drawings and claims. All such changes, modifications, variations and other uses and applications which do not depart from the spirit and scope of the invention are deemed to be covered by the invention which is limited only be the claims which follow.

The inventor claims:

1. An insulating structure having a plurality of modules for installation adjacent an associated structural surface, and a plurality of associated parallel supporting members, each of said supporting members extending at right angles from said structural surface, each module extending from two adjacent supporting members, each module being disposed in side by side relation to at least one other module, each of said modules comprising:

first and second sidewalls in spaced substantially parallel relationship, each having inner and outer edges;

said first sidewall including a tab strip along its said inner edge foldable outwardly upon itself for connection of said inner edge of the first supporting structure adjacent the structural surface after the inner edge of said second sidewall has been connected adjacent the structural surface, said tab strip being formed from a portion of said first sidewall, and being defined by fold-enabling means, said first and second sidewalls being dimensioned and configured to depend from respective facing surfaces of the first and second parallel supporting surfaces;

a plurality of reflective foil sheets connected to the first and second sidewalls, said foil sheets being oriented in mutually spaced substantially parallel relationship to extend (1) intermediate and (2) generally at right angles to said first and second sidewalls, the majority of said plurality of reflective foil sheets being disposed at a lower elevation than the lowest elevation of the first and second parallel supporting structures; and one of said first and second sidewalls including a tensioning member along the outer edge thereof, each of said modules being attached by one of said tensioning members to at least one adjacent module at their respective outer side wall edges with their respective outer sidewalls in spaced relationship from said supporting structure and said supporting members to define an air space adjacent to the lowermost face of the supporting members.

2. The insulating structure defined in claim 1, wherein:

said insulating structure includes means for joining adjacent modules to provide a substantially closed air space about each supporting structure, said modules being substantially disposed in spaced relation from each supporting structure.

3. The insulating structure defined in claim 2, wherein:

said fold enabling means along said inner edge of said first sidewall include a score line.

4. The insulating structure defined in claim 3, wherein:

said fold enabling means along said inner edge of said first sidewall further includes a paper strip along said score line to reinforce it.

5. The insulating structure defined in claim 4, wherein:

said second sidewall includes a tab strip along its said inner edge foldable outwardly upon itself for connection of said inner edge to the supporting structure adjacent the structural surface in a manner similar to the connection of said first sidewall.

6. The insulating structure defined in claim 5, wherein:

the outermost and innermost of said plurality of foil sheets have a paper backing on the side thereof facing an adjacent foil sheet.

7. The insulating structure defined in claim 6, wherein:

said plurality of foil sheets are an odd number of sheets and said foil sheets are alternately paper-backed and unbacked.

8. The insulating structure as described in claim 7, wherein:

said tensioning member is more flexible than said first and second sidewalls.

* * * * *